United States Patent [19]

Kort

[11] Patent Number: 4,628,154

[45] Date of Patent: Dec. 9, 1986

[54] ANNULAR GAP MAGNET SYSTEM, PARTICULARLY FOR LOW FREQUENCY LOUDSPEAKERS

[76] Inventor: Eckehard K. Kort, Lichtenhagen 28, 3251 Ottenstein 2, Fed. Rep. of Germany

[21] Appl. No.: 452,769

[22] Filed: Dec. 23, 1982

[30] Foreign Application Priority Data

Dec. 24, 1981 [DE] Fed. Rep. of Germany ..... 3151530
Sep. 17, 1982 [DE] Fed. Rep. of Germany ... 8226166[U]

[51] Int. Cl.[4] ..... H04R 9/02

[52] U.S. Cl. ..... 381/189; 335/231; 381/199

[58] Field of Search ..... 179/120, 119 R, 117, 179/115.5 R, 115.5 SF; 335/231

[56] References Cited

U.S. PATENT DOCUMENTS 3,073,411 1/1963 Bleazey ..... 179/115.5 R
3,803,522 4/1974 Rooney ..... 179/120
3,881,074 4/1975 Kawamura ..... 179/115.5 R

FOREIGN PATENT DOCUMENTS 244558 4/1963 Australia ..... 179/115.5 ME
2024258 12/1971 Fed. Rep. of Germany ..... 179/120
52-44627 4/1977 Japan ..... 179/117
53-76824 7/1978 Japan ..... 179/117
55-46645 4/1980 Japan ..... 179/115.5 R
587645 1/1978 U.S.S.R. ..... 179/120

*Primary Examiner*—Gene Z. Rubinson
*Assistant Examiner*—Danita R. Byrd
*Attorney, Agent, or Firm*—Gottlieb, Rackman & Reisman

[57] ABSTRACT

An annular gap magnet system, in particular for a low frequency loudspeaker (Woofer), in which a coil is movable with a large stroke in the working air gap. A braking air gap provided in the region of the inner or lower pole plate produces a magnetic resistance in the pole plate so that a part of the magnetic flux flows over the braking air gap. This magnetic flux is opposed to the stray magnetic flux below the working air gap and excites a counter magnetic field which opposes further inward movement of the moving coil. In this way an impact of the moving coil against the inner or lower pole plate is prevented. In a low frequency loudspeaker the membrane carrying the moving coil may, therefore, be suspended extremely softly.

9 Claims, 8 Drawing Figures

ANNULAR GAP MAGNET SYSTEM, PARTICULARLY FOR LOW FREQUENCY LOUDSPEAKERS

BACKGROUND OF THE INVENTION

The invention concerns an annular gap magnet system, particularly for low frequency loudspeakers (Woofers) in which a moving coil moves with a large stroke in the working air gap, with a cylindrical pole core of soft iron and an annular permanent magnet arranged at a distance from the pole core between an outer (herein called the upper) pole plate limiting the working air gap and an inner (herein called the lower) pole plate. The invention also concerns low frequency loudspeakers and electromagnetic drives having an annular gap magnet system of this type.

DESCRIPTION OF THE PRIOR ART

In low frequency loudspeakers it is desirable to produce an extremely soft suspension of the membrane carrying the moving coil. This has the result that the moving coil after having left the main magnetic field in the working air gap of the magnet system is drawn further inward by the internal stray field below the working air gap and, in particular, if overloaded it strikes against the lower pole plate.

In order to prevent such an impact of the moving coil against the lower pole plate it has been necessary hitherto to make a compromise in that the membrane and the moving coil are suspended stiffer than is desirable from the point of view of the acoustic quality of the loudspeaker.

The basic object of the invention is to design an annular gap magnet system or a loudspeaker of the type described in the introduction in such a way that even with an extremely soft suspension of the membrane and the moving coil, impact of the moving coil against the lower pole plate is prevented with certainty even when the loudspeaker is overloaded.

SUMMARY OF THE INVENTION

This object is solved according to the invention in that in or on the inner, that is the lower, pole plate, at a distance from the outer, that is the upper, pole plate which is at least equal to the thickness of the upper pole plate, there is provided a braking air gap surrounding the pole core in its lower region as an axial extension of the working air gap, and that, in the region of the lower end of the braking air gap in the lower pole plate there is provided a magnetic resistance of a magnitude such that the magnetic flux through the braking air gap and the stray flux above the braking air gap, both of which are directed oppositely to the magnetic flux in the working air gap and also oppositely to the stray flux below the working air gap, are at least equal in sum to the oppositely directed stray flux below the working air gap.

By means of said magnetic flux through the braking air gap and the stray flux above the braking air gap, both of which are directed oppositely to the magnetic flux in the working air gap and to the internal stray field in the region surrounding the working air gap, there is produced a magnetic counter force, of well defined magnitude, which prevents impact of the moving coil against the lower pole plate even when the loudspeaker is overloaded and, in particular, independent of the softness of the membrane suspension.

The magnetic resistance can be generated by a reduction in the cross-section of the lower pole plate. It is, however, also possible to provide a connecting element without or with low magnetic conductivity between the lower pole plate and the pole core.

For the purpose of easy tuning of the loud speaker to any given desired acoustic quality and/or for reasons of economy, there may be provided adjacent the lower pole plate a soft iron ring which limits the braking air gap at least over a part of its axial length and which is in magnetically conducting connection with the internal circumference of the permanent magnet ring. The depth of the braking air gap and its distance from the upper pole plate may be varied by the insertion of soft iron rings of different heights.

It is, however, also possible for the dimensions of the braking air gap to be limited over part of its axial length by the annular permanent magnet, where the annular permanent magnet is conveniently constructed from two permanent magnets in series, of which that magnet which is situated facing away from the working air gap forms by means of its external circumference the external limit of the dimensions of the braking air gap at least over part of its axial length.

BRIEF DESCRIPTION OF THE DRAWINGS

Further details and advantages of the invention will arise from the following description of preferred embodiments illustrated schematically by way of example in the drawings of which the figures are, in axial cross-section as follows.

DESCRIPTION OF THE PREFERRED EMBODIMENTS

Figure 1:
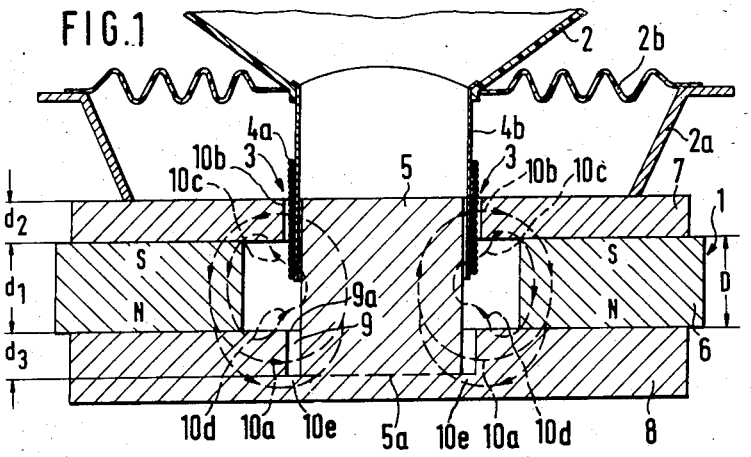
FIG. 1 shows a loudspeaker having a first embodiment of an annular gap magnet system with braking air gap.

In FIG. 1 there is illustrated schematically a low frequency loudspeaker having an annular gap magnet system 1, a conical membrane 2 and a membrane cage 2*a*. A cylindrical body 4*b* on which a moving coil 4*a* is mounted is attached rigidly to the membrane. A centering membrane 2*b* is arranged between the inner (i.e. the lower, as shown,) end of the membrane 2 and the membrane cage 2a. The loudspeaker cage 2a is rigidly attached to the magnet system in the usual way. The annular gap magnet system 1 has a cylindrical pole core 5 of soft iron and an annular permanent magnet 6 with a thickness D which is fixed concentric with the pole core 5 between an annular upper pole plate 7 of thickness $d_2$ and a lower pole plate 8. A working air gap 3, into which the moving coil 4a dips, is formed between the pole core 5 and the internal circumference of the upper pole plate 7, situated concentric with the pole core.

In FIG. 1, as in FIGS. 2–6, the pole core 5 and the lower pole plate 8 are illustrated as if designed to be of unitary construction. Normally, the pole core 5 and the pole plate 8 are two separate bodies which are, for example, connected rigidly together by screws or rivets. This is indicated in FIG. 1 by the dashed line 5a.

The moving coil 4a is designed in such a way that is moves in the working air gap 3 of the magnet system with a suitable stroke, for example the typical large stroke of a low frequency loudspeaker (Woofer).

In or on the lower pole plate 8 there is provided a cylindrical annular braking air gap 9 with depth $d_3$ which surrounds the pole core 5 as an axial extension of the working air gap and into which the moving coil can dip at its lower end.

The open end 9a of the braking air gap 9 is situated in all embodiments shown by way of example at a distance $d_1$ from the lower side of the upper pole plate 7, said distance being at least equal to the thickness $d_2$ of the upper pole plate 7, but preferably larger.

The braking air gap 9, which extends within the lower pole plate 8, produces a decrease in the area of the cross-section of the lower pole plate at its lower end in a manner which results in an increase in the magnetic resistance 10e.

FIG. 1 shows in dashed lines the magnetic flux which is produced by the braking air gap 9 and the magnetic resistance 10e. Because of the magnetic resistance 10e, the magnetic flux from the lower pole plate 8 to the pole core 5 passes to a large extent 10a through the braking air gap 9 and the stray magnetic flux 10d above the open end 9a of the braking air gap 9 flows substantially from the inner rim and the adjacent upper side of the pole plate 8 to the pole core 5. The magnetic flux 10a and the stray flux 10d forming the braking flux are, in sum, at least equal to the internal stray flux 10c between the pole core 5 and inner rim and the adjacent lower side of the upper pole plate 7 beyond the working air gap 3 and are preferably larger. If the moving coil slips into the magnet systems, it leaves the magnetic field in the working air gap. It is then driven further inwardly by the stray flux 10c. Counteracting the drive caused by the stray flux 10c is the sum of the braking fluxes 10a and 10d. In this way the moving coil 4a is actively braked and is thus prevented from striking against the lower pole plate.

In other embodiments only the annular gap magnet system is illustrated in each case. Similar parts or parts with similar function are, in each case, given the same reference numbers as in FIG. 1. Therefore, in each case, only those characteristics by which the magnet systems differ from the embodiment shown in FIG. 1 are described in the following.

Figure 2:
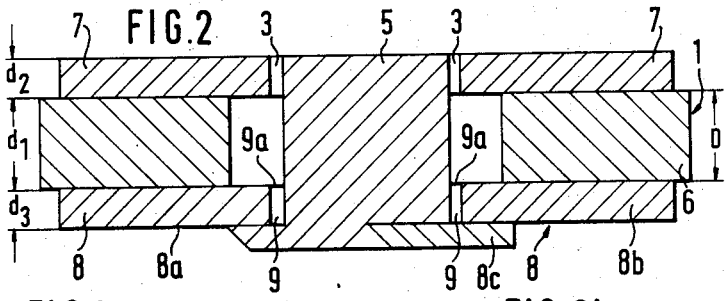
FIG. 2 shows a further embodiment of the magnet system modified with respect to FIG. 1 in a manner requiring less material in the lower pole plate.

In FIG. 2 the lower pole plate 8 has on the left-hand side of the centre line a recess 8a in its lower side which extends radially outward from the braking air gap 9 for economy of material or reduction in weight. To the right of the centre line a modification is illustrated in which the lower pole plate is formed by a ring 8b and a plate 8c. The pole core 5 is fixed centrally on the plate 8c the thickness of which determines the magnetic resistance.

Figure 3A:
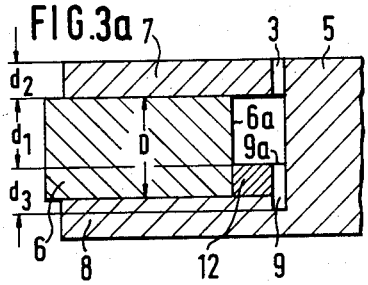
FIGS. 3*a* and 3*b* show, in each case partial representations of two additional embodiments having soft iron rings for the external limitation of the dimensions of the braking air gap.

While, in the embodiments shown in FIGS. 1 and 2, the whole depth $d_3$ of the braking air gap 9 lies within the lower pole plate 8, in the embodiment shown in FIG. 3a only a part $d_3$ of the depth of the braking air gap is formed within the lower pole plate, in particular its lower end. A soft iron ring 12 is arranged on the upper side of the lower pole plate 8 and its external surface is applied with magnetic conductivity against the inner surface 6a of the permanent magnet ring 6, while with its internal surface it limits the dimensions of the braking air gap over part of its depth.

Figure 3B:
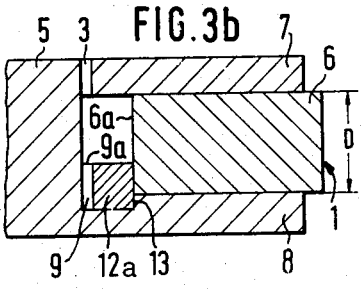

In a similar manner in the embodiment shown in FIG. 3b, a soft iron ring 12a is provided, which in this case has a height such that by means of its internal surface it limits the dimensions of the braking air gap externally over its whole depth $d_3$. The soft iron ring 12a is here set into a suitable recess 13 in the lower pole plate 8.

Figure 4:
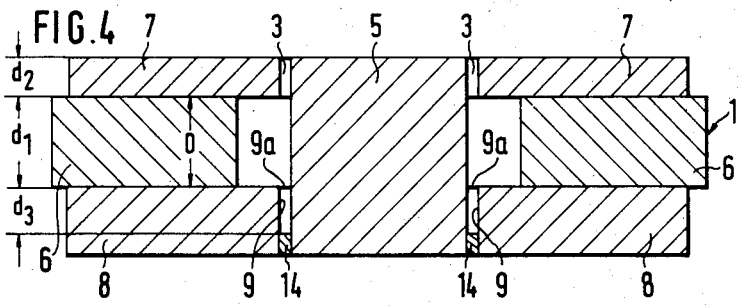
FIG. 4 shows an additional embodiment in which the pole core and the lower pole plate are connected together by means of an intermediate ring of non-magnetic material below the braking air gap.
Figure 5:
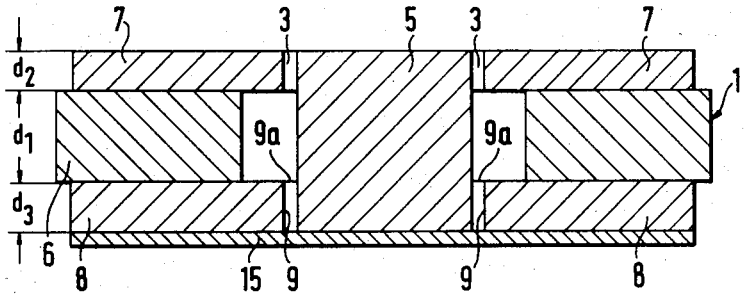
FIG. 5 shows an additional embodiment in which the pole core and the lower pole plate are connected rigidly together by means of a plate or disc of non-magnetic material.

In contrast to the embodiments of FIGS. 1 to 3a and 3b, in the embodiments according to FIGS. 4 and 5 no soft iron ring is provided between the annular lower pole plate 8 and the pole core 5. In the embodiment of FIG. 4 there is provided, between the internal surface of the lower pole plate 8 and the outer surface of the pole core 5, a ring 14 of limited height by means of which the two bodies are connected to one another. The ring 14 consists of a non-magnetic material such as, for example, brass, aluminium, synthetic material or the like. In the embodiment shown in FIG. 5 a similar effect is produced due to the fact that the annular lower pole plate 8 and the pole core 5 are fixed on a plate 15 of non-magnetic material. Since there is no longer any bridge of soft iron present, the whole magnetic flux passes through the braking air gap in the embodiment shown in FIGS. 4 and 5.

Figure 6:
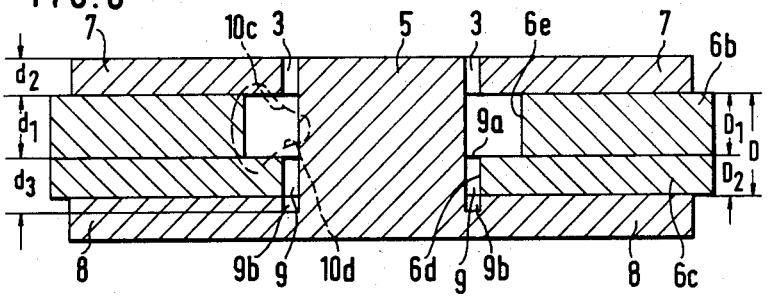
FIG. 6 shows an additional embodiment in which the dimensions of the braking air gap is limited over part of its axial length by means of the annular permanent magnet.

In the embodiment shown in FIG. 6, the annular permanent magnet 6 is made up of two partial magnet rings 6b and 6c, each with thickness $D_1$ or $D_2$, which in sum corresponds to a thickness D of the permanent magnet 6 of FIG. 1. The upper partial magnet 6b has an internal diameter which is equal to the internal diameter of the magnet 6 according to FIG. 1. The lower partial magnet 6c has an internal diameter which is equal to the external diameter of the braking air gap 9. Thus it forms with its internal surface 6d, the external surface of the braking air gap 9 which extends as an annular cavity 9b into the lower pole plate 8 so as to determine the reduction in cross-section which determines the magnetic resistance. The thickness $d_1$ of the magnet 6b is chosen in such a way that the condition that the distance between the open end 9a of the braking air gap 9 and the lower side of the upper pole plate 7 is at least equal to the height of the working air gap and thus to the thickness $d_2$ of the upper pole plate is again satisfied.

The advantage of this embodiment, as in the embodiments of FIGS. 3a and 3b, resides in the fact that for a predetermined height of the braking air gap the thickness of the lower pole plate can be made less than in the embodiments of FIGS. 1 and 2. The weight of the magnet system is thereby decreased.

In FIG. 6, to the left of the pole core, there is illustrated the stray magnetic flux which, in this embodiment with its lower region 10d directed towards the pole core, flows substantially radially through the braking air gap 9.

Figure 7:
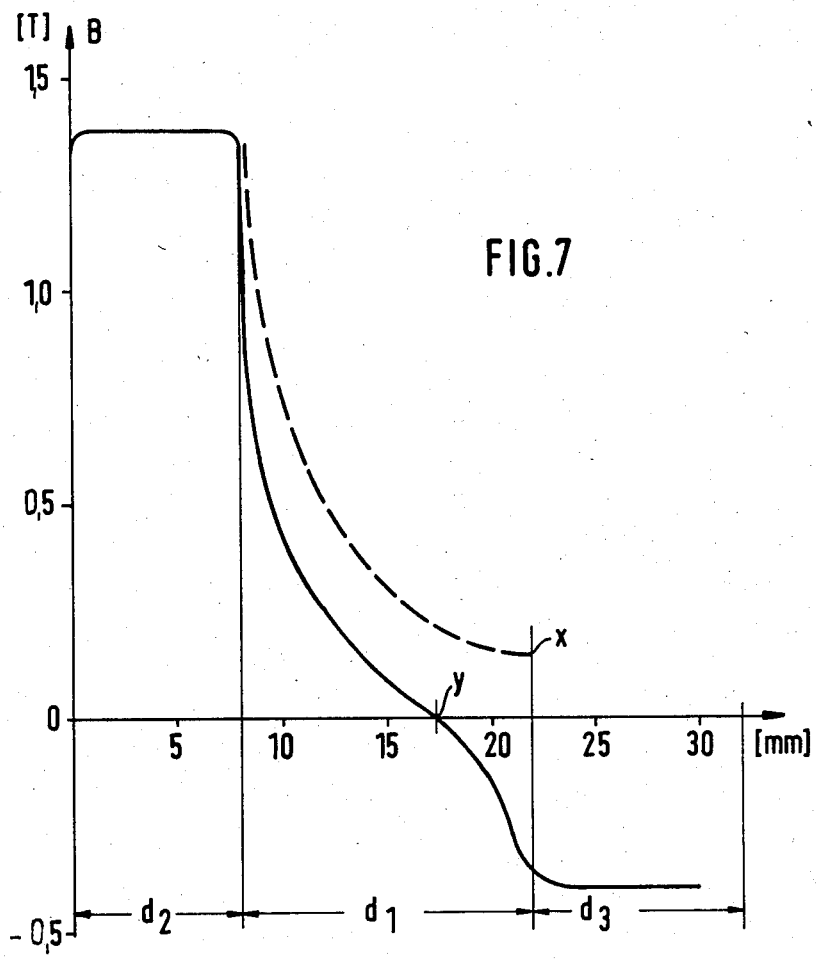
FIG. 7 is a diagram showing the variation in magnetic field strength over the height of an annular gap magnet system according to the invention.

In a ring magnet system according to the embodiment of FIG. 3*b* having dimensions as follows:

$d_2 = 8$ mm $d_1 = 14$ mm $d_3 = 10$ mm the magnetic flux density B was measured over the total height $d_1 + d_2 + d_3$ by means of a Hall probe, where the measurements were limited to a total depth of 30 mm since useful results of measurement could no longer be obtained in the neighbourhood of the base of the braking air gap. The results of measurement are shown diagrammatically in FIG. 7.

Above the abscissa, the magnetic flux is directed away from the pole core and below the abscissa it is directed towards the pole core. As can be seen in the diagram, the magnetic flux density is substantially constant over the thickness $d_2$ of the upper pole plate 7, that is over the height of the working air gap 3. Over the height $d_1$, that is between the lower side of the upper pole plate 7 and the open end 9*a* of the braking air gap 9, the density of magnetic flux resulting from the stray field 10*c* falls fairly steeply. Thus, the magnetic flux density becomes 0 at the point Y, that is at a distance of 9 mm from the lower edge of the upper pole plate 7. From the point Y onwards the stray field 10*d* is effective. Here the flux density rises again with oppositely directed magnetic flux and, at about the region of the open end 9*a* of the braking air gap, reaches its maximum, the magnitude of which depends on the magnitude of the magnetic resistance in the lower pole plate. The flux density then remains substantially constant over the depth of the braking air gap in the region measured. In the diagram the flux density is shown in Tesla (T).

As a comparison measurement, measurements were made of the magnetic flux density in an annular gap magnet system of conventional type, that is without the braking air gap.

The flux density in the working air gap is the same as in the magnet system with braking air gap. Below the working air gap a flux density was measured which corresponds to the dashed curve shown in the diagram. This curve falls less steeply and remains above the abscissa in the whole region. Immediately on the upper side of the lower pole plate, that is at the point X, the flux density is still about 0.3 T. Thus, in a normal magnet system no magnetic counterfield is built up which limits the inward movement of the moving coil. In fact, up to the upper side of the lower pole plate 8, there exists a magnetic field which promotes the inward movement of the moving coil and which is the cause of the impact of the moving coil against the lower pole plate when the loudspeaker is overloaded.

In contrast, in the annular gap magnet system with the braking air gap as described above, impact of the moving coil does not occur even at maximum overload of the loudspeaker. The inward movement of the moving coil is, in fact, braked by the counter magnetic field generated above the braking air gap and is thus limited.

Annular gap magnetic systems according to the invention are not only useful with loudspeakers, but can be used with their full advantage also with electromagnetic drives demanding a relatively large undamped stroke. For instance said moving coil can be constructed as a driving element for a writing element.

What I claim as my invention and desire to secure by Letters Patent of the United States is:

1. A low frequency loudspeaker having an annular gap magnet system comprising:

a moving coil connected to a loudspeaker membrane and movable in a working air gap, said working air gap having an outer diameter;

a cylindrical pole core of soft iron;

an annular permanent magnet surrounding at least a portion of the pole core;

an upper pole plate which limits the outer diameter of the working air gap and a lower pole plate between which said annular permanent magnet is positioned, said lower pole plate having a cross-section;

said lower pole plate having at a distance from said upper pole plate, which is at least equal to the thickness of said upper pole plate, a braking air gap which surrounds said pole core in its lower part as an axial extension of the working air gap and, in the region of the lower end of the braking air gap in said lower pole plate;

wherein said braking air gap extends into said lower pole plate for decreasing the cross-section of said lower pole plate below the bottom of said braking air gap to produce a magnetic resistance;

wherein there is present a magnetic flux through the braking air gap, a stray flux above the braking air gap, and an internal stray flux below the working air gap; and wherein said magnetic resistance is of such a magnitude that said magnetic flux through the braking air gap and said stray flux above the braking air gap are both directed oppositely to the magnetic flux in the working air gap and also oppositely to the stray flux below the working air gap, and are in sum at least equal to said internal stray flux below the working air gap.

2. An electromagnetic drive having an annular gap magnet system comprising a moving coil connected to a loudspeaker membrane and movable in a working air gap, said working air gap having an outer diameter; a cylindrical pole core or soft iron; an annular permanent magnet arranged at a distance from the pole core; an upper pole plate which limits the outer diameter of the working air gap and a lower pole plate between which said annular permanent magnet is positioned, said lower pole plate having a cross-section, said lower pole plate having at a distance from said upper pole plate, which is at least equal to the thickness of said upper pole plate; and a braking air gap which surrounds said pole core in its lower part as an axial extension of the working air gap and, in the region of the lower end of the braking air gap in said lower pole plate, wherein said braking air gap extends into said lower pole plate for decreasing the cross-section of said lower pole plate below the bottom of said braking air gap to produce a magnetic resistance, wherein there is a magnetic resistance of such a magnitude that the magnetic flux through the braking air gap and the stray flux above the braking air gap, both of which are directed oppositely to the magnetic flux in the working air gap and also oppositely to the stray flux below the working air gap, are in sum at least equal to the internal stray flux below the working air gap.

3. An annular gap magnet system, particularly for low frequency loudspeakers, comprising a moving coil moveable in the working air gap, said working air gap having an outer diameter, a cylindrical pole core of soft iron; an annular permanent magnet arranged at a distance from said pole core; a first pole plate which limits the outer diameter of the working air gap; a second pole plate contacting said pole core and having a cross-section, said annular permanent magnet being positioned between said first and second pole plates, said second pole plate being at a distance from said first pole plate which is at least equal to the thickness of said first pole plate, wherein a braking air gap is formed surrounding said pole core adjacent to said second pole plate as an axial extension of the working air gap, wherein said braking air gap extends into said second pole plate for decreasing the cross-section of said second pole plate below the bottom of said braking air gap to produce a magnetic resistance, wherein there is a magnetic flux through the braking air gap and a stray flux above the braking air gap, both fluxes directed opposite to a magnetic flux in the working air gap and also oppositely to a stray flux below the working air gap, wherein the flux in the braking air gap is at least equal in magnitude to the stray flux below the working air gap.

4. An annular gap magnet system according to claim 3, wherein there is adjacent said second pole plate a soft iron ring which limits the external dimensions of the braking air gap over part of its axial length, said soft iron ring having an axis surrounded in part by said annular permanent magnet, said iron ring and said permanent magnet being in magnetically conductive contact.

5. An annular gap magnet system according to claim 4 wherein said part of the height of said permanent magnet is less than the difference between the height of said permanent magnet and the height of said first pole plate.

6. An annular gap magnet system according to claim 4 wherein said soft iron ring abuts said second pole plate.

7. An annular gap magnet system according to claim 4 wherein said second pole plate is recessed to receive said soft iron ring.

8. An annular gap magnet system according to claim 3, wherein the outer diameter of the braking air gap is limited at least over part of its axial length by the internal circumference of said annular permanent magnet.

9. An annular gap magnet system according to claim 8 wherein said annular permanent magnet is constructed from two magnets in series, of which the internal circumference of that magnet which is situated further from the working air gap limits the dimensions of the braking air gap at least over part of the axial length of said braking air gap.

* * * * *